US008497756B2

(12) United States Patent
Kiyono et al.

(10) Patent No.: US 8,497,756 B2
(45) Date of Patent: Jul. 30, 2013

(54) REACTOR CORE AND REACTOR

(75) Inventors: Takaaki Kiyono, Okazaki (JP); Masaki Sugiyama, Aichi-ken (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 12/441,848

(22) PCT Filed: Sep. 19, 2007

(86) PCT No.: PCT/JP2007/068736

§ 371 (c)(1),
(2), (4) Date: Mar. 18, 2009

(87) PCT Pub. No.: WO2008/035807

PCT Pub. Date: Mar. 27, 2008

(65) Prior Publication Data

US 2009/0315663 A1 Dec. 24, 2009

(30) Foreign Application Priority Data

Sep. 19, 2006 (JP) ..... 2006-253166

(51) Int. Cl.

| | |
|---|---|
| ***H01F 27/30*** | (2006.01) |
| ***H01F 17/06*** | (2006.01) |
| ***H01F 27/24*** | (2006.01) |
| ***H01F 17/04*** | (2006.01) |

(52) U.S. Cl.

USPC ..... 336/198; 336/178; 336/212; 336/219; 336/221; 336/233; 336/208

(58) Field of Classification Search

USPC ..... 336/219, 145, 178, 185, 196, 212, 336/216, 233, 90, 96, 198, 208, 221

See application file for complete search history.

(56) References Cited

U.S. PATENT DOCUMENTS

| | | | | |
|---|---|---|---|---|
| 4,095,206 | A * | 6/1978 | Hishiki | 336/96 |
| 4,227,166 | A * | 10/1980 | Tsuji et al. | 336/229 |
| 5,581,224 | A * | 12/1996 | Yamaguchi | 336/212 |
| 5,977,855 | A * | 11/1999 | Matsumura et al. | 336/96 |
| 6,033,594 | A | 3/2000 | Enokido et al. | |
| 6,078,242 | A | 6/2000 | Tomita et al. | |
| 6,246,172 | B1 * | 6/2001 | Bizen et al. | 315/5.41 |

(Continued)

FOREIGN PATENT DOCUMENTS

| | | |
|---|---|---|
| CN | 1211049 A | 3/1999 |
| CN | 1476488 A | 2/2004 |

(Continued)

OTHER PUBLICATIONS

Chinese Patent Office Action dated Jan. 19, 2011 and English-language translation thereof.

(Continued)

*Primary Examiner* — Mohamad Musleh
*Assistant Examiner* — Mangtin Lian
(74) *Attorney, Agent, or Firm* — Sughrue Mion, PLLC

(57) ABSTRACT

In a reactor core, a gap section between a plurality of core material portions is fixed by adhesion through a spacer, and a resin is arranged vertical to the adhering surface between the core material and the spacer, for sandwiching at least a part of the core material. The resin material preferable a molded material.

3 Claims, 5 Drawing Sheets

U.S. PATENT DOCUMENTS

| | | | | |
|---|---|---|---|---|
| 6,445,270 | B1 * | 9/2002 | Ogasawara | 336/182 |
| 6,600,402 | B1 * | 7/2003 | LaFleur et al. | 336/61 |
| 6,771,157 | B2 * | 8/2004 | Nishikawa et al. | 336/178 |
| 2003/0222748 | A1 * | 12/2003 | Cern et al. | 336/178 |
| 2004/0046632 | A1 | 3/2004 | Kumano et al. | |
| 2004/0126609 | A1 | 7/2004 | Ueta et al. | |
| 2005/0007232 | A1 * | 1/2005 | Ono et al. | 336/213 |
| 2007/0090916 | A1 * | 4/2007 | Rao | 336/229 |
| 2007/0188289 | A1 * | 8/2007 | Kumano et al. | 336/219 |

FOREIGN PATENT DOCUMENTS

| | | | |
|---|---|---|---|
| EP | 1486993 | A1 | 12/2004 |
| JP | 63-084918 | U | 6/1988 |
| JP | 06-275447 | A | 9/1994 |
| JP | 9-35965 | A | 2/1997 |
| JP | 2000-195730 | A | 7/2000 |
| JP | 2003-051414 | A | 2/2003 |
| JP | 2003-124039 | A | 4/2003 |
| JP | 2003-173917 | A | 6/2003 |
| JP | 2004-140316 | A | 5/2004 |
| JP | 2005-057150 | A | 3/2005 |
| JP | 2005-302900 | A | 10/2005 |
| JP | 2005-347626 | A | 12/2005 |
| JP | 2006-032786 | A | 2/2006 |
| JP | 2006-100513 | A | 4/2006 |
| JP | 2006-135018 | A | 5/2006 |
| JP | 2006-294829 | A | 10/2006 |
| JP | 2006-351662 | A | 12/2006 |
| WO | 2006-016554 | A1 | 2/2006 |

OTHER PUBLICATIONS

Japanese Patent Office Action dated Jan. 11, 2011 and partial English-language translation thereof.

English translation of relevant parts of German Office Action dated Oct. 29, 2012 issued in German Patent Application 11 2007 002 205.1.

* cited by examiner

REACTOR CORE AND REACTOR

TECHNICAL FIELD

The present invention relates to a reactor, and more particularly to a reactor mounted on a vehicle such as a hybrid vehicle.

BACKGROUND ART

Reactors for use in vehicles such as hybrid vehicles have a structure in which a magnetic gap having a predetermined width is formed between a plurality of core materials in order to prevent a reduction in inductance. More specifically, an integral core, which is formed by inserting a spacer such as ceramic or the like into a gap portion between each pair of core materials, and bonding the core material and the spacer which are adjacent to each other together using an adhesive, is used.

FIG. 9 is a schematic view for explaining an example conventional reactor and a method of manufacture thereof. Specifically, between a core material 12 having a predetermined thickness and having an arc shape or a substantially U-shape (hereinafter referred to as a "U core material") and a core material 14 having the same thickness as the U core material 12 and having a column shape or a substantially I-shape (hereinafter referred to as an "I core material"), a spacer 16 having the same thickness as the U core material 12 and the I core material 14 is inserted (see FIG. 9(*a*)).

The spacer 16 is bonded to each of the U core material 12 and the I core material 14 by using an adhesive, to thereby form a core assembly 18 having a substantially J-shape (hereinafter referred to as a "J core assembly). After coil bobbins 20*a* and 21*b* are formed on the J core assembly 18, a coil 48*a* is disposed or wound over the outer peripheral surface of the coil bobbin 20*a* to form a J core member 24 (see FIG. 9(*b*)).

A J core member 44 having the same shape as that of the J core member 24 is formed in the same manner as the J core member 24. Then, the J core member 24 and the J core member 44 are arranged such that an end surface 13 of the U core material 12 and an end surface 15 of the I core material 14 of the J core member 24 face an end surface 35 of an I core material 34 and an end surface 33 of a U core material 32 of the J core member 44, respectively (see FIG. 9(*c*)).

The J core members 24 and 44 are then bonded to each other via spacers 22 and 42 by using an adhesive, so that a reactor 50 including an annular core 46 formed of a plurality of core materials coupled with each other via the spacers, and coils 48*a* and 48*b* provided on the outer peripheral surfaces of the coil bobbins 20 and 21, respectively, is obtained (see FIG. 9(*d*)). It should be noted that FIG. 9 illustrates the structure of the coil bobbins 20 and 21 (in FIGS. 9(*b*) and 20*a*, 20*b*, 21*a*, and 21*b* in FIG. 9(*c*)) and the coils 48*a* and 48*b* provided on the outer peripheral surface of the core 46 only in a schematic cross section, in order to show the detailed structure of the adhesion surfaces between the core materials and the spacer and the vicinity thereof.

Conventionally, a powder magnetic core, a laminated steel sheet composed of a plurality of electromagnetic steel sheets, and so on have been used as a core material for a reactor. In recent years, with an increasing demand for a further reduction in costs in hybrid vehicles on which a reactor is mounted and so on, a powder magnetic core is preferably used as a core material from the viewpoint of reduction in the material costs and the manufacturing costs. The powder magnetic core as used herein is manufactured using soft magnetic powders having a particle size of about 100 μm, for example, in such a manner that after processing the powder surfaces with insulation treatment using an insulating material, a binder is added as necessary, and the powders are subjected to pressure forming and further subjected to baking or thermal treatment, as required.

The powder magnetic core generally exhibits a lower Young's modulus than the laminated steel sheet, and therefore a reactor in which the powder magnetic core is used is subjected to effects of an electromagnetic attractive force in the adhesion direction between the core material and the spacer, which may result in generation of a large amount of vibration. Generation of vibration as described above may further lead to disadvantages including generation of noise and peeling of at least a part of the adhesion surface between the core material and the gap plate.

JP 2006-135018 A describes that, in a core of a reactor in which a laminated steel sheet is used, a gap spacer includes a projection portion, on a surface of the gap spacer to be bonded to a core material, which comes into contact with the core material, so that a space to be filled with an adhesive is provided between the gap spacer and the core material to thereby ensure the spreading area and the thickness of the adhesive, thereby preventing peeling of the adhesion portion and also suppressing a noise generated by the reactor.

The invention described in the above-described in JP 2006-135018 A may show excellent advantages when a certain degree of mechanical strength of the core material itself is ensured, such as when a laminated steel sheet is employed, for example. However, particularly when a powder magnetic core is applied as the core material, the mechanical strength of the core material itself is generally lower than the core material in which a laminated steel sheet or the like is applied, and at the time of handling, such as mounting of a reactor and so on, and particularly during travelling of a vehicle in which such a reactor is mounted, the core material may suffer from deficiencies caused by vibration or the like. It is therefore preferable that the strength of the core material itself is reinforced simultaneously with reinforcement of the adhesion performance between the core material, formed of a powder magnetic core, and the spacer.

Here, while it is possible to reinforce the mechanical strength of the powder magnetic core which is used as the core material to a certain degree by increasing the amount of binder, an increase in the amount of binder may degrade other desirable material characteristics such as magnetic permeability. It is therefore very difficult to maintain these material characteristics in a desirable state while adjusting the amount of binder. Also, because desirable material characteristics as a core material vary depending on the case in which the core material is actually used, it is very difficult and impractical to prepare core materials having various material characteristics and at the same time to increase the strength of the core material itself.

DISCLOSURE OF THE INVENTION

Structures according to embodiments of the present invention are as follows:

(1) In a core of a reactor, a gap portion between a plurality of core materials is fixed by adhesion via a spacer, and a supporting material which supports at least a portion of the core materials is provided vertically with respect to an adhesion surface between the core materials and the spacer.

(2) In the core of a reactor described above, the core material includes a powder material core containing a magnetic material which is treated with insulation processing.

(3) In the core of a reactor described above, the supporting material is a molding material.

(4) In the core of a reactor described above, a coil bobbin which allows a coil to be provided around the core is further provided, and the coil bobbin is integrally molded with the supporting material.

(5) A reactor includes the core described above, and a coil provided around the coil bobbin.

(6) In a core of a reactor, each of gap portions between a plurality of core materials is bonded for integration of the core, and a holding material which holds the core materials so as to cover at least a portion of each of the gap portions is provided.

(7) In a core of a reactor, each of gap portions between a plurality of core materials is bonded for integration of the core, and a holding material which holds the core materials so as to cover each of the gap portions is provided.

(8) In the core of a reactor described above, a spacer is disposed in each of the gap portions.

(9) In the core of a reactor described above, the holding material is a molding material.

(10) In the core of a reactor described above, the holding material is formed of a resin which shrinks at least when cooled and hardened.

(11) In the core of a reactor described above, at least a portion of an outer periphery of the core is covered with the molding material.

(12) In the core of a reactor described above, at least the whole of an outer periphery of the core is covered with the molding material.

(13) In the core of a reactor described above, at least a portion of an outer peripheral surface of the holding material also serves as a coil bobbin around which a coil can be provided.

(14) In the core of a reactor described above, the holding material holds at least two gap portions.

(15) In the core of a reactor described above, the core is formed by using at least four core materials.

(16) In the core of a reactor described above, an engaging member which engages the gap portion is further provided vertically with respect to an adhesion surface between the core material and the spacer.

(17) In the core of a reactor described above, the engaging member is integrally molded with a coil bobbin having an outer peripheral surface around which a coil can be provided.

(18) A reactor includes the core described above, and a coil bobbin which is provided around a coil bobbin provided to the core.

BRIEF DESCRIPTION OF THE DRAWINGS

These and other objects of the invention will be explained in the description below, in connection with the accompanying drawings, in which.

BEST MODE FOR CARRYING OUT THE INVENTION

Preferred embodiments of the present invention will be described with reference to the drawings.

Embodiment 1

Figure 1:
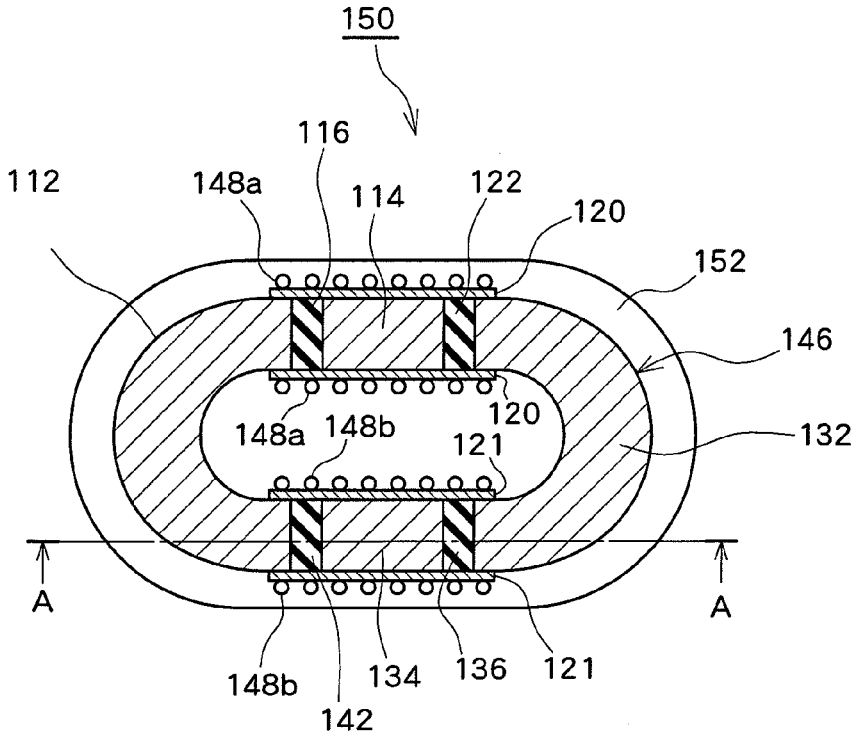
FIG. 1 is a view schematically illustrating a structure of a reactor according to an embodiment of the present invention.
Figure 9:
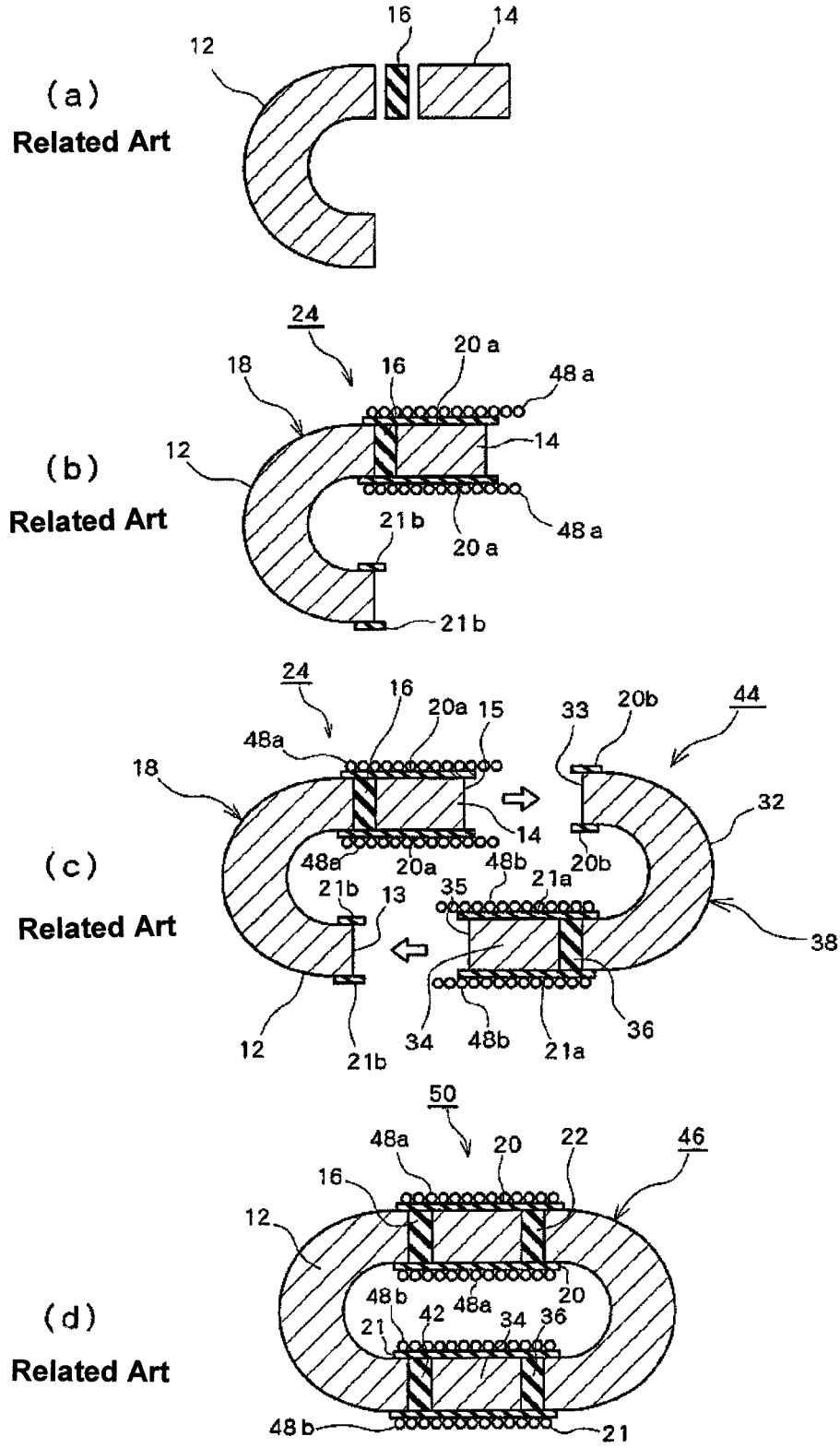
FIG. 9 is a view schematically illustrating an example conventional reactor and a manufacturing method thereof.

FIG. 1 is a view schematically illustrating a structure of a reactor according to an embodiment of the present invention. In FIG. 1, a reactor 150 has substantially the same structure as that of the conventional reactor 50 illustrated in FIG. 9(*d*) except that the reactor 150 includes a resin 152. Specifically, the reactor 150 includes an annular core 146 formed of a plurality of core materials connected with each other via spacers, and coils 148*a* and 148*b* provided on the outer peripheral surfaces of coil bobbins 120 and 121, respectively. The core 146 includes U core materials 112 and 132 having a predetermined thickness, and I core materials 114 and 134 having the same thickness as the U core materials. End surfaces of adjacent core materials are bonded together via spacers 116, 122, 136, and 142, respectively, having substantially the same thickness as the U core materials and I core materials.

The resin 152 functions as a holding material which holds the core materials such that the resin 152 covers a part or whole of each gap portion between adjacent core materials in which the spacer is provided. As such, the resin 152 is capable of reinforcing adhesion between the core materials and spacers.

Alternatively, it is also possible to use a molding material as the resin 152 and provide the resin 152 by overmolding such that the resin 152 covers the outer peripheral surface of the core 146 as illustrated in FIG. 1. In particular, in a reactor in which a powder magnetic core is used as a core material, the structure illustrated in FIG. 1 allows reinforcement of the mechanical strength of the core or the core material itself, in addition to reinforcement of the adhesive strength between the core material and the spacer.

Figure 2:
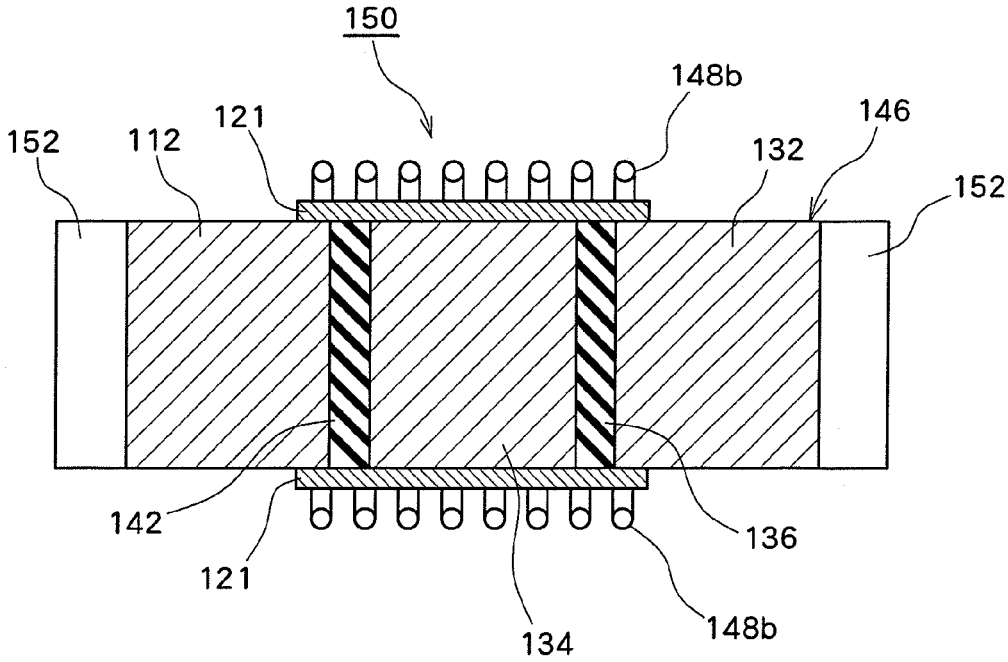
FIG. 2 is a schematic cross sectional view of the reactor of FIG. 1, taken along line A-A of FIG. 1.

FIG. 2 schematically illustrates a cross section of the reactor 150 of FIG. 1 taken along line A-A. In FIG. 2, the resin 152 is located in the outermost peripheral portion of the reactor 150, and serves as a supporting material which supports the core materials vertically with respect to the adhesion surfaces between the U core material 112 and 132 and the I core materials 134 and the spacers 136 and 142. As such, the resin 152 is capable of reinforcing adhesion between the core materials and the spacers. In this regard, if the molding material which is used as a holding material or a supporting material, i.e. the resin 152, has a nature of shrinking when it is cooled and hardened, to enable continuous application of a compressive stress in the adhesion direction between the core material and the spacer, adhesion between the core material and the spacer can be further reinforced.

Embodiment 2

Figure 3:
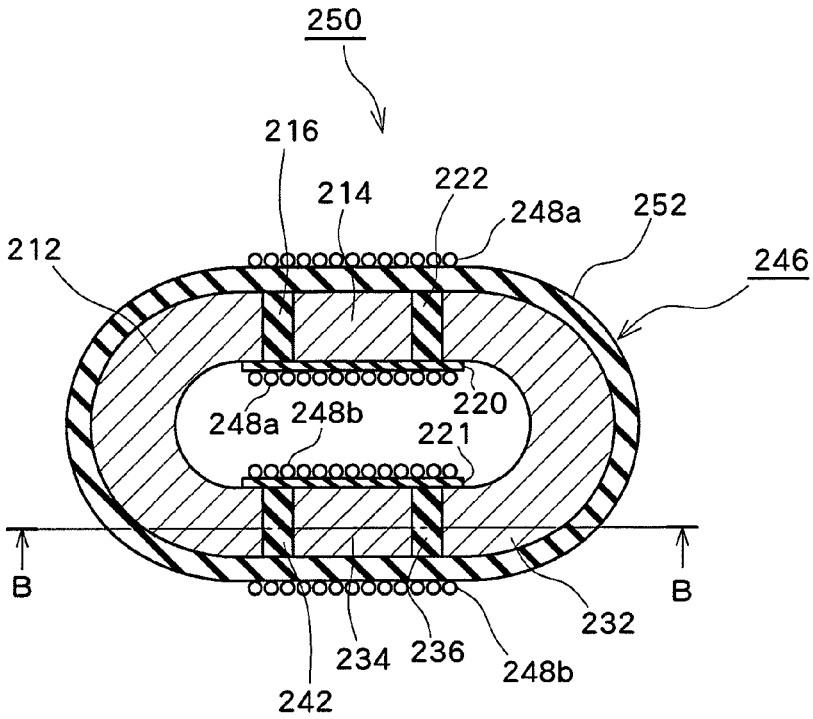
FIG. 3 is a view schematically illustrating a structure of a reactor according to another embodiment of the present invention.

FIG. 3 is a view schematically illustrating a structure of a reactor according to another embodiment of the present invention. In FIG. 3, a reactor 250 has substantially the same structure as that of the conventional reactor 50 illustrated in FIG. 9(*d*) except that the reactor 250 includes a resin 252 and coil bobbins 220 and 221, in spite of the coil bobbins 20 and 21. Specifically, the reactor 250 includes an annular core 246 formed of a plurality of core materials coupled with each other via spacers, and coils 248*a* and 248*b* provided on the outer peripheral surface of core 246. Further, the core 246 includes U core materials 212 and 232 and I core materials 214 and 234. End surfaces of adjacent core materials are bonded together via spacers 216, 222, 236, and 242.

In this embodiment, the coil bobbins 220 and 221 are integrally molded with the resin 252 using the same resin material as the resin 252. The coil 248*a* is provided by winding around the coil bobbin 220 and a portion of the outer peripheral surface of the resin 252 which is provided to cover the outer peripheral surface of the spacers 216 and 222. On the other hand, the coil 248*b* is provided by winding around the coil bobbin 221 and a portion of the outer peripheral surface of the resin 252 which is provided to cover the outer peripheral surface of the spacers 236 and 242. As such, portions of the outer peripheral surface of the resin 252 over which the coils 248*a* and 248*b* are provided also serve as the coil bobbins. As a result, forming of the coil bobbins and molding by using a resin can be performed simultaneously, which advantageously results in a reduction in the number of components and the number of manufacturing steps. At this time, in order to provide the coil at a predetermined position, it is possible to provide a restriction member on at least a part of each of the coil bobbins 220 and 221 for restricting the position where the coil is to be provided, or the winding shape of the coil.

Figure 4:
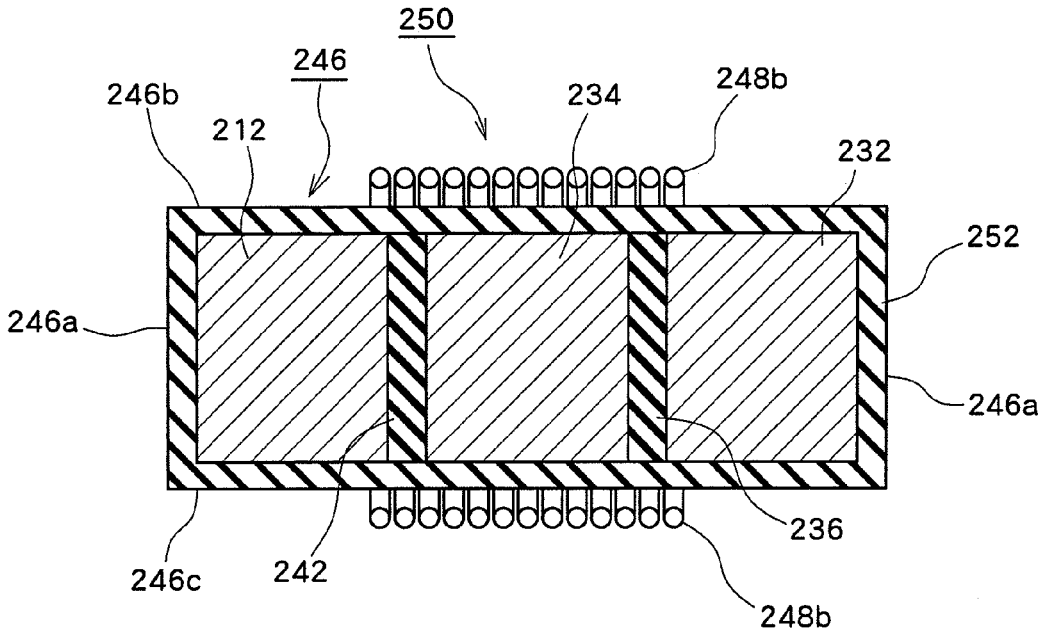
FIG. 4 is a schematic cross sectional view of the reactor of FIG. 3, taken along line B-B of FIG. 3.

FIG. 4 schematically illustrates a cross section of the reactor 250 of FIG. 3 taken along line B-B of FIG. 3. In FIG. 4, the resin 252 protects a whole peripheral portion of each of gap portions in which the spacers 242 and 236 are inserted, respectively, to thereby maintain adhesion between the U core material 212 and the spacer 242, between the I core material 234 and the spacer 242, between the I core material 234 and the spacer 236, and between the U core material 232 and the spacer 236. Further, as in the reactor 150 illustrated in FIGS. 1 and 2, with the resin 252 supporting the U core materials 212 and 232 from outside thereof, respectively, adhesion between each core material and the space can be reinforced.

In this embodiment, covering or molding of the core 246 with the resin 252 may be performed prior to providing the coils 248*a* and 248*b* by winding, or alternatively, the core 246 covered with the resin 252 is formed by overmolding after previously disposing or winding the coils 248*a* and 248 over the core materials or the spacers, with or without a predetermined space between the core material or the spacer and the coils 248*a* and 248*b*.

While in the embodiment illustrated in FIG. 4 the resin 252 covers not only the outer peripheral surface 246*a* of the core 246 but also the whole of the top surface 246*b* and the bottom surface 246*c* of the core 246, the structure of this invention is not limited to this example, and can have any other structures in which the resin 252 is provided so as to hold the core materials such that the resin 252 covers at least each of the spacers 236 and 242 and to simultaneously serve as the coil bobbin.

Further, in a modified example of this embodiment, the coil bobbins 220 and 221 may not be formed of the same material as the resin 252. For example, it is possible to form the coil bobbins 220 and 221 and the resin 252 by two-color molding using different materials simultaneously, and then increase heat resistance of only the coil bobbins 252. It is also possible to manufacture only the coil bobbins in a separate step using a method which is set as appropriate.

Embodiment 3

Figure 5:
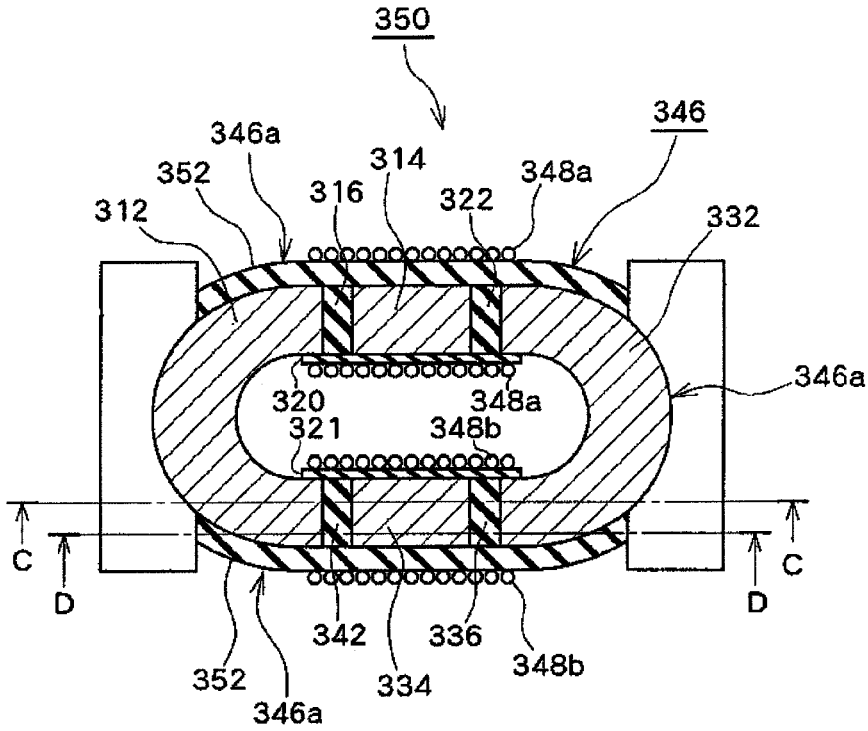
FIG. 5 is a view schematically illustrating a structure of a reactor according to still another embodiment of the present invention.

FIG. 5 schematically illustrates a structure of a reactor according to another embodiment of the present invention. In FIG. 5, the shape of a reactor 350 is substantially the same as that of the reactor 250 illustrated in FIG. 3, except that in the reactor 350, a resin 352 is used in place of the resin 252.

Referring to FIG. 5, the resin 352 differs from the resin 252 of FIG. 3 in that the resin 352 covers only a part of the outer periphery 346*a* of the core 346. Specifically, while a cross sectional shape of the reactor 350 taken along line D-D is substantially the same as the cross sectional shape of the reactor 250 in FIG. 4, a cross sectional shape of the reactor 350 taken along line C-C in FIG. 5 differs from the cross sectional shape illustrated in FIG. 4. More specifically, the resin 352 covers a part of the outer periphery 346*a* of the core 346 to thereby support at least a part of the core materials in the vertical direction with respect to adhesion surfaces between a plurality of core materials and spacers. Accordingly, in this embodiment, as in the above-described embodiments, it is possible to reinforce adhesion between each core material and the spacer.

Figure 6:
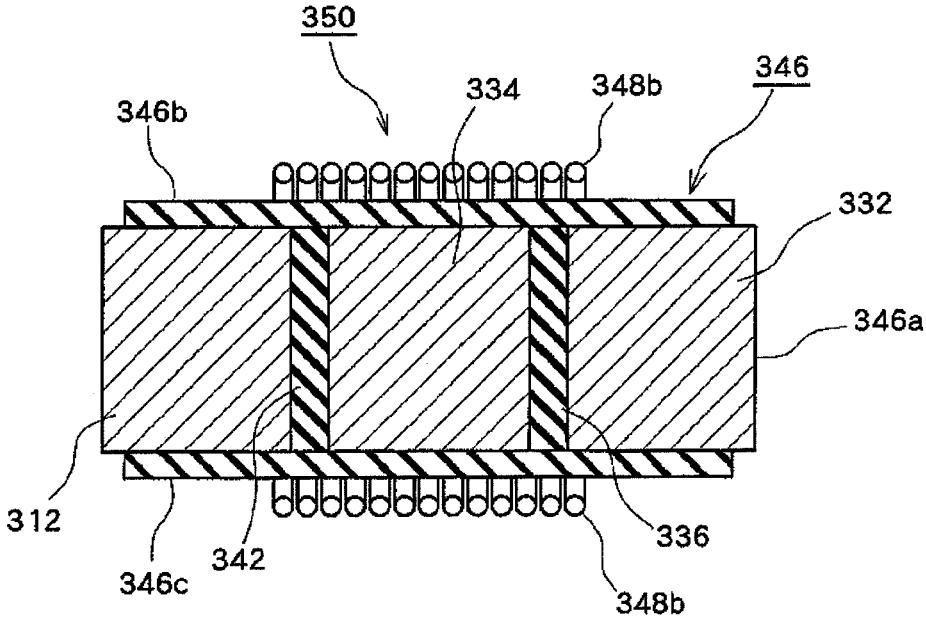
FIG. 6 is a schematic cross sectional view of the reactor of FIG. 5, taken along line C-C of FIG. 5.

FIG. 6 schematically illustrates a cross section of the reactor 350 taken along line C-C in FIG. 5. In FIG. 6, in the reactor 350, the resin 352 and coil bobbins 320 and 321 (not shown in FIG. 6; see FIG. 5) which are integrally formed with the resin 352 hold the core materials so as to cover at least spacers 342 and 336, so that adhesion between each core material and the spacer can be reinforced.

Embodiment 4

Figure 7:
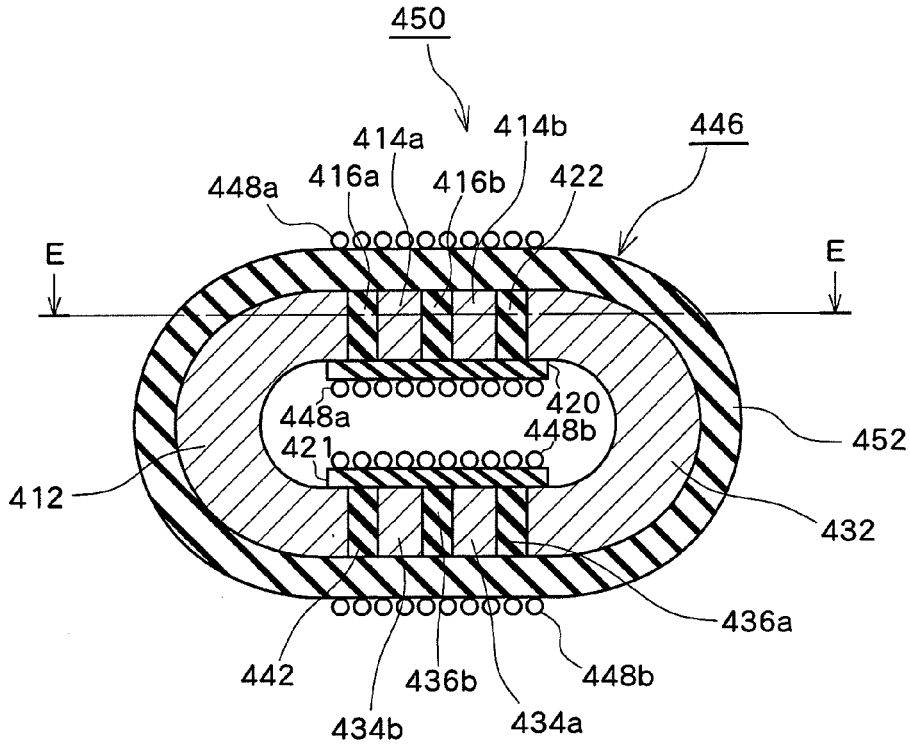
FIG. 7 is a view schematically illustrating a structure of a reactor according to a further embodiment of the present invention.

FIG. 7 schematically illustrates a structure of a reactor according to another embodiment of the present invention. In FIG. 7, the shape of a reactor 450 differs from shapes of the reactors illustrated in Embodiments 1 to 3 with regard to the number of spacers and I core materials. Specifically, the reactor 450 has a structure which is composed of a core 446 including U core materials 412 and 432, I core materials 414*a*, 414*b*, 434*a*, and 434*b*, and spacers 416*a*, 416*b*, 422, 436*a*, 436*b*, and 442, which are covered with a resin 452, and coils 448*a* and 448*b*. Thus, it is generally possible to appropriately set the power and performance of a reactor by varying the number of spacers and varying a spacer width, i.e. a gap width.

While the reactor illustrated in FIG. 7 may be manufactured by any method, the following method, for example, may be adopted for manufacturing the reactor 450. First, the U core material 412 and the I core materials 414*a* and 414*b* are bonded together via the spacers 416*a* and 416*b*, to thereby form a first J core assembly. Similarly, the U core material 432 and the I core materials 434*a* and 434*b* are bonded together via the spacers 436*a* and 436*b*, to thereby form a second J core assembly. (First step)

Over a portion of the first J core assembly which corresponds to the coil bobbin 420 and a portion on the peripheral surface of the resin 452 corresponding to the coil bobbin in FIG. 7, a coil 448*a* is provided by insertion or winding, with a predetermined space therebetween, to thereby manufacture a first J core member. On the other hand, over a portion of the second J core assembly corresponding to the coil bobbin 421 and a portion on the peripheral surface of the resin 452 corresponding to the coil bobbin, a coil 448*b* is provided by insertion or winding, with a predetermined space therebetween, to thereby manufacture a second J core member.

(Second Step)

The first J core member and the second J core member are then bonded together via the spacers 422 and 442, to thereby form an integral member of the respective core materials and the spacers. (Third step)

Finally, the bobbins 420 and 421 and the resin 452 are integrally molded by overmolding, using a molding material as a resin material, to thereby manufacture the reactor 450. (Fourth Step)

As described above, by molding the coil bobbins 420 and 421 and the resin 452 integrally, the adhesion portion between each core material and the spacer and the core materials themselves can be reinforced in a simple manner without making the manufacturing process complicated.

A modified example of the reactor 450 illustrated in FIG. 7 and the manufacturing method thereof will be described with reference to FIG. 8.

Figure 8:
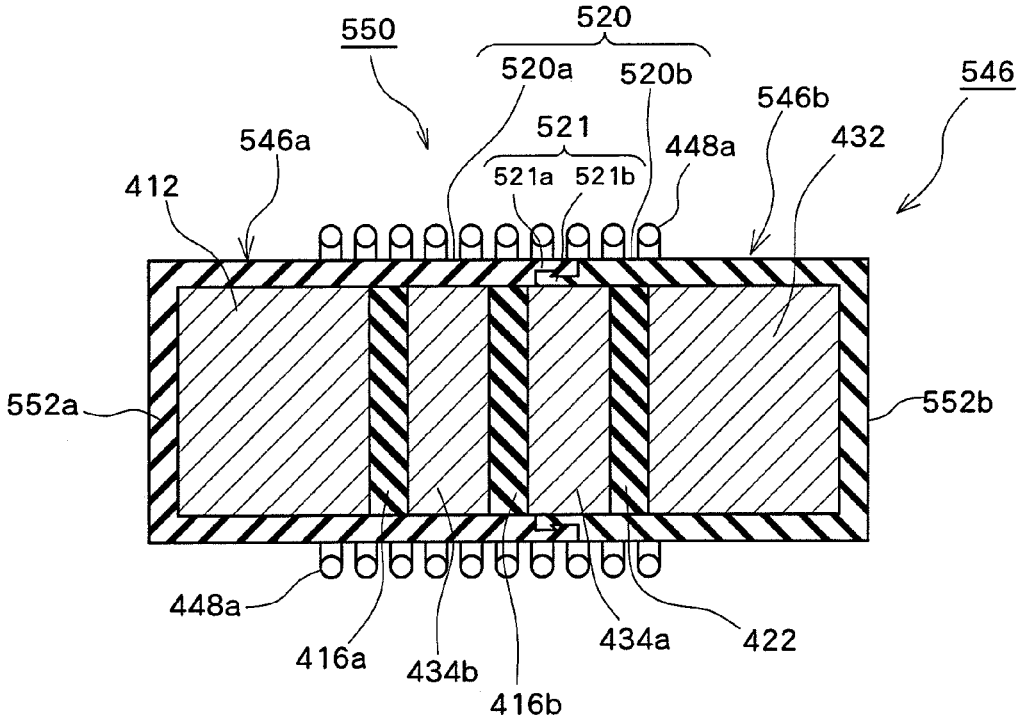
FIG. 8 is a cross sectional view schematically illustrating the reactor according to the further embodiment of the present invention.

FIG. 8 is a schematic cross sectional view of a reactor 550 according to the present embodiment, which corresponds to a cross section of the reactor 450 illustrated in FIG. 7 taken along E-E line. In FIG. 8, elements similar to those in FIG. 7 are designated by the same numerals and will not be described.

The reactor 550 shown in FIG. 8 is formed by including a core 546 which is composed of two J core members 546*a* and 546*b* which are separated in one coil bobbin 520 and the other coil bobbin which is not shown in FIG. 8. Specifically, in FIG. 8, the first J core member 546*a* includes a U core material 412 and I core materials 434*a* and 434*b*, which are bonded together via spacers 416*a* and 416*b*. A molding material is then applied to this first J core member 546*a* so that a coil bobbin 520*a* and a resin 552*a* are integrally molded with the first J core member 546*a*. Similarly, a coil bobbin 520*b* and a resin 552*b* are integrally molded with the second J core member 546*b* by using a mold material. Here, at the time of molding, hooks or engaging mechanisms 521 which can be engaged or fitted with each other at the time of integral molding of the core 546 are formed at an end portion 521*a* of the coil bobbin 520*a* on the side of the second J core member 546*b* and at an end portion 521*b* of the coil bobbin 520*b* on the side of the first J core member 546*a*. With these engaging mechanisms 521 in combination of an adhesive, the first J core member 546*a* and the second J core member 546*b* are bonded to each other more firmly, so that the adhesion portion between the core materials and the spacers can be held and reinforced.

In this embodiment, the hook or engaging mechanism 521 may have any shape as long as the contact area to which an adhesive can be applied can be increased and also the adhesion performance can be enhanced at the time of integral molding of the core 546. A preferable shape is a shape which can be easily molded from a molding material and which enables reliable engagement or fitting between two members. Although snap-fitting is one example of such a hook or engaging mechanism 521, the mechanism 521 is not limited to this example.

Further, in the embodiment illustrated in FIG. 8, the resin 552*a* and the coil bobbin 520*a*, and the resin 552*b* and the coil bobbin 520*b*, are integrally molded respectively. However, the present invention is not limited to this example, and the resins 552*a* and 552*b* can be molded with reference to other embodiments of the present invention described above, or by a combination of methods described above, as long as the hooks or the engaging mechanisms 521 are provided at contact portions of the coil bobbins 520*a* and 520*b*.

According to this embodiment, even when there is concern about the adhesion performance of the core as a whole due to the increase of the adhesion portions between the core material and the spacer by increasing the number of gaps as illustrated in FIG. 8, adhesion between each core material and the spacer can be reinforced. Further, the hooks or the engaging mechanisms 521 can be applied regardless of the number of the spacers.

In the embodiments of the present invention, while any material, such as a laminated steel sheet and a powder magnetic core, may be used as the material of each core material, an identical material is generally used for molding all the core materials. In particular, a reactor in which a core material using a powder magnetic core is employed has a relatively large surface roughness compared to a metal steel sheet, for example, and can therefore exhibit an excellent adhesion effect with respect to the molding material which is used as a holding material due to the anchor effect.

In the embodiments of the present invention, ceramic or the like is preferably used as a material of the spacer to be inserted in a gap portion between the core materials. Further, in order to achieve stable performance of the reactor, the respective spacers preferably have an identical size so as to unify the gap width among a plurality of core materials. Further, in order to manufacture a reactor having a desired output performance, it is preferable that at least 4 spacers, and 6 or more spacers in some cases, are employed.

In the embodiments of the present invention, it is preferable that an adhesive for bonding the core materials and the spacers has at least heat resistance and has desired adhesion performance in accordance with the material properties, size, shape, and other features of the core materials and the spacers which are used. A preferable adhesive may include a phenolic resin adhesive, an epoxy resin adhesive, and so on.

In the embodiments of the present invention, a resin having at least an insulating property and heat resistance is preferably used for the coil bobbin. The heat resistance includes heat cycle properties. The coil bobbin may be manufactured by injection molding, for example. Preferable examples of a resin for the coil bobbin may include PPS (polyphenylene sulfide), PA (polyamide), LCP (liquid crystal polymer), and so on. Further, a coil bobbin having a coil previously wound thereover may be disposed over the core material or the core assembly.

In the embodiments of the present invention, it is sufficient that a preferable molding material used for the holding material and the supporting material can at least enhance the adhesion strength between the core material and the spacer, and portions to be overmolded are not particularly limited. Examples materials of the molding material may include a resin having desirable insulation properties and heat resistance, such as unsaturated polyester, epoxy, phenol, urethane, PPS, and other resins. In particular, with the use of a resin having a property of shrinking when cooled and hardened as the molding material, further enhancement of the holding or supporting performance can be advantageously achieved.

In particular, in the embodiment in which the coil bobbin and the resin are integrally molded as illustrated in FIGS. 2 and 4, the resin also needs to have characteristics of the coil bobbin. It is therefore preferable to apply a molding resin having heat resistance and heat cycle properties. Specific examples of preferable resin material may include PPS and LPC.

Preferable properties of a resin which can be used as a material of the molding material may include, for example, a tensile strength of about 1 to 160 Mpa, a Young's modulus of about 1 to 150,000 Mpa, and a thermal conductivity of about 0.2 to 3 W/mK. However, the preferable properties are not limited to these examples and may be appropriately set in accordance with, for example, the properties of the core material which is used, the output properties of the reactor, and other properties.

Here, it is possible to measure the tensile strength of a resin which is used for the molding material in accordance with JISK6251, measure the Young's modulus in accordance with JISK7113, and measure the thermal conductivity in accordance with JISK2616.

In the embodiments of the present invention, metal materials such as aluminum, copper, and other materials are preferably used for the coil. When the coil is wound after the core is manufactured, it is preferable to set the thickness or sectional shape of the coil such that the coil can be wound around the coil bobbin, in accordance with the material of the coil which is used. Further, when a coil which is previously molded in a winding shape is disposed over the core material or the core assembly, a coil material having flexibility is preferably used so as to suppress damage to the core material or the coil bobbin.

It should be noted that while in the embodiments of the present invention described above with reference to FIGS. 1 to 8, all of the coils which are wounded or provided over the periphery of the core are in a completely exposed state, the coils may be in any state as long as the coils are not in direct contact with the core materials and the spacers due to the presence of a predetermined gap or an insulting resin between the coil and the core material and the spacer, and whether or not the coil is exposed when the reactor is externally viewed does not matter. In other words, it is possible to form the whole reactor including the coils by overmolding. In addition, in the embodiments of the present invention, when overmolding is performed using a molding material, it is possible to perform not only molding with respect to the core or the reactor but also fixing of the reactor to a predetermined portion in which the reactor is to be stored, such as a reactor case, for example.

EXAMPLES

Examples of the present invention will be described in detailed below. It should be noted, however, that the present invention is not limited to these examples.

<Measuring Method of Resin Characteristics>

First, in the examples, each property was measured as follows.

The tensile strength of a resin which is used as a molding material was measured by using a universal tester 4465 manufactured by Instron at a testing rate of 500 mm/min.

The Young's modulus of the resin was measured by using a universal tester, Strograph T-D, manufactured by Toyo Seiki Seisaku-sho co., Ltd., at a testing rate of 1 mm/min.

The thermal conductivity of the resin was measured by using QTM-500 manufactured by Kyoto Electronics Manufacturing co., Ltd.

<Core Material>

For both the U core materials and the I core materials, iron powders having an average particle size of 100 μm were used as the soft magnetic powders, and a powder magnetic core in which insulation processing is applied to powder surfaces by using a silicone resin was used.

<Spacer>

A ceramic spacer having a gap width of 1.5 mm was used.

<Adhesive>

Bonding between each member was performed using an epoxy resin adhesive which was applied in an appropriate amount.

<Coil>

A rectangular copper coil was used. Here, the number of windings was set to a desired value.

Example 1

An epoxy resin which was prepared to have a tension strength of 65 Mpa, a Young's modulus of 4,700 Mpa, and a thermal conductivity of 0.8 W/mK was applied to the reactor illustrated in FIGS. 1 and 2 to thereby obtain a reactor 1. Here, a coil bobbin which was obtained by injection molding using a PPS resin was used.

Example 2

A PPS resin which was prepared to have a tension strength of 160 Mpa, a Young's modulus of 12,800 Mpa, and a thermal conductivity of 0.4 W/mK was applied to the reactor illustrated in FIGS. 3 and 4 to thereby obtain a reactor 2.

Example 3

A PPS resin which is similar to that in Example 2 was applied to the reactor illustrated in FIGS. 5 and 6 to thereby obtain a reactor 3.

Example 4

A PPS resin which was prepared to have a tension strength of 146 Mpa, a Young's modulus of 16,200 Mpa, and a thermal conductivity of 0.4 W/mK was applied to the reactor illustrated in FIG. 8 to thereby obtain a reactor 4.

Comparative Example 1

A reactor 5 having a structure which is similar to that of the reactor 1 obtained in Example 1 except that overmolding using a resin is not performed in the reactor 5.

<Evaluation>

Whether or not the core materials and the spacers are peeled from each other was visually inspected while repeating 300 cycles of a temperature cycle test, in which 1 cycle includes a process of raising the temperature from −40° C. to 150° C. in 40 minutes and then lowering the temperature from 150° C. to −40° C. in 40 minutes. As a result, with regard to the reactors 1 to 4, no peeling was recognized between the core materials and the spacers. With regard to the reactor 5, on the other hand, the core materials and the spacers were stripped from each other due to an insufficient adhesion strength and fell off.

As described above, according to the embodiments and the modified examples of the present invention, it is possible to reinforce adhesion between the core materials and the gap plate and increase the strength of the reactor, while maintaining the material characteristics of the core materials and the performance of the reactor.

INDUSTRIAL APPLICABILITY

The present invention can be used in a preferable manner in a reactor in which a gap portion between a plurality of core materials is fixed by adhesion via a spacer.

The invention claimed is:

1. A core of a reactor which is formed in an annular shape, the annular core comprising:

a gap portion between a plurality of core materials fixed by adhesion via a spacer, wherein at least one of the core materials includes a powder magnetic core containing a magnetic material which is treated with insulation processing, and wherein the core further comprises:

a supporting material which covers an outer peripheral surface of the annular core so as to support at least a portion of the core materials in a direction vertical to an adhesion surface between the core materials and the spacer; and a coil bobbin which allows a coil to be provided around the core, the coil bobbin including an inner peripheral side coil bobbin disposed on an inner peripheral surface of the annular core and an outer peripheral side coil bobbin which is disposed opposite the inner peripheral side coil bobbin and disposed on an outer peripheral surface of the annular core, and the inner peripheral side coil bobbin being integrally molded with the supporting material, and wherein at least a portion of an outer peripheral surface of the supporting material functions as the outer peripheral side coil bobbin and the coil is wound around the inner peripheral side coil bobbin and the outer peripheral side coil bobbin.

2. A core of a reactor which is formed in an annular shape, the annular core comprising:

gap portions between a plurality of core materials, wherein each one of the gap portions is bonded for integration of the core, wherein at least one of the core materials includes a powder magnetic core containing a magnetic material which is treated with insulation processing, wherein a spacer is arranged at each of the gap portions, and wherein the core further comprises:

a holding material which covers at least a portion of each of the gap portions and applies a compressive stress in a direction vertical to an adhesion surface between the core materials and the spacer to thereby hold the core materials; and a coil bobbin which allows a coil to be provided around the core, the coil bobbin including an inner peripheral side coil bobbin disposed on an inner peripheral surface of the annular core and an outer peripheral side coil bobbin which is disposed opposite the inner peripheral side coil bobbin and disposed on an outer peripheral surface of the annular core, and the inner peripheral side coil bobbin being integrally molded with the holding material, and wherein at least a portion of an outer peripheral surface of the holding material functions as the outer peripheral side coil bobbin and the coil is wound around the inner peripheral side coil bobbin and the outer peripheral side coil bobbin.

3. A core of a reactor which is formed in an annular shape, the annular core comprising:

gap portions between a plurality of core materials, wherein each one of the gap portions is bonded for integration of the core, wherein at least one of the core materials includes a powder magnetic core containing a magnetic material which is treated with insulation processing, wherein a spacer is arranged at each of the gap portions, and wherein the core further comprises:

a holding material which covers each of the gap portions and applies a compressive stress in a direction vertical to an adhesion surface between the core materials and the spacer to thereby hold the core materials; and a coil bobbin which allows a coil to be provided around the core, the coil bobbin including an inner peripheral side coil bobbin disposed on an inner peripheral surface of the annular core and an outer peripheral side coil bobbin which is disposed opposite the inner peripheral side coil bobbin and disposed on an outer peripheral surface of the annular core, and the inner peripheral side coil bobbin being integrally molded with the holding material, and wherein at least a portion of an outer peripheral surface of the holding material functions as the outer peripheral side coil bobbin and the coil is wound around the inner peripheral side coil bobbin and the outer peripheral side coil bobbin.

* * * * *